United States Patent [19]

Boquette, Jr.

[11] 3,935,816

[45] Feb. 3, 1976

[54] CONSTRUCTION FOR CARTRIDGE

[75] Inventor: Lawrence E. Boquette, Jr., Long Beach, Calif.

[73] Assignee: Howard S. Klotz, New York, N.Y.

[22] Filed: Jan. 9, 1974

[21] Appl. No.: 431,949

[52] U.S. Cl. ..... 102/41; 102/43 P; 102/92.7

[51] Int. Cl.[2] ..... F42B 5/22

[58] Field of Search ..... 102/41, 92.7, 43, 43 P, 102/38

[56] References Cited

UNITED STATES PATENTS

| | | | |
|---|---|---|---|
| 3,146,712 | 9/1964 | Maurer et al. | 102/41 |
| 3,609,904 | 10/1971 | Scanlon | 102/43 P |
| 3,732,826 | 5/1973 | Johnson | 102/43 P |

FOREIGN PATENTS OR APPLICATIONS

| | | | |
|---|---|---|---|
| 732,633 | 6/1955 | United Kingdom | 102/43 P |
| 860,593 | 2/1961 | United Kingdom | 102/43 P |

*Primary Examiner*—Samuel Feinberg
*Assistant Examiner*—C. T. Jordan
*Attorney, Agent, or Firm*—Ostrolenk, Faber, Gerb & Soffen

[57] ABSTRACT

A bullet is formed of an explosive charge with a primer at one end and a projectile mass at the other end, all enclosed in a continuous plastic sheath. The sheath has a weakened central section to define a line of separation for a projectile section from the body of the plastic sheath when the explosive charge is fired. By controlling the weight of the projectile and the stress required to separate the plastic case at the weakened section, the impact characteristics of the projectile can be controlled. A blank is fabricated by eliminating the projectile and forming the weakened sheath section at the end of the sheath. The combined primer and charge is encased by a thin, plastic sheath portion which is thin enough to allow a weapon firing pin to fire the primer. The combined primer and charge is also formed of a small caliber blank with a conventional brass case.

6 Claims, 6 Drawing Figures

FIG. 1
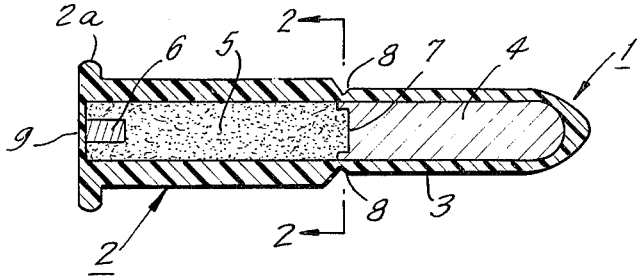
FIG. 2
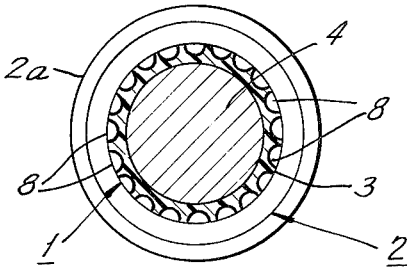
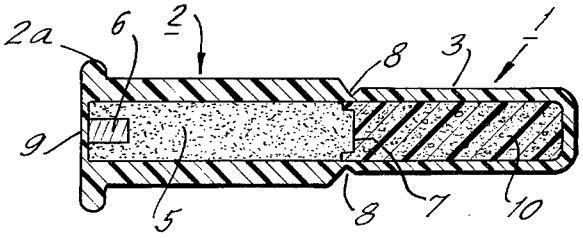
FIG. 3.
FIG. 4.
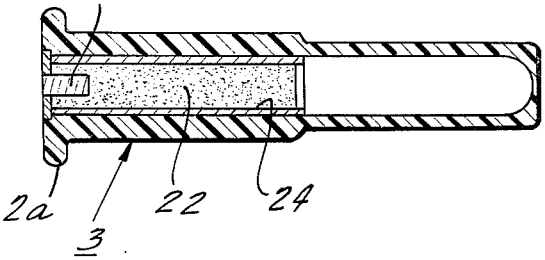
FIG. 5.
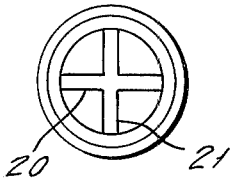
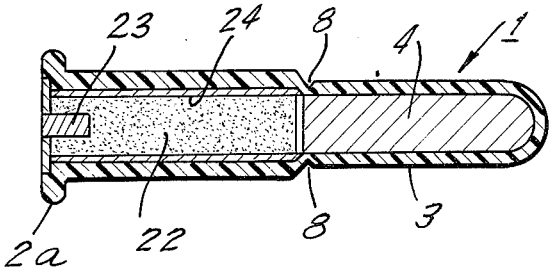
FIG. 6.

CONSTRUCTION FOR CARTRIDGE

BACKGROUND OF THE INVENTION

This invention relates to cartridges for use in weapons of various types, and more specifically relates to a novel cartridge structure using a principally plastic housing. The novel cartridge of the invention provides improved ammunition characteristics and has lower cost while being useful in a wide range of functions including training, combat, riot control, and the like.

Brass cartridge ammunition is well known. The qualities of brass in the required deep draw operations to form cartridge shells have heretofore made it the preferred material for this use.

However, it has long been recognized that there are numerous drawbacks to the use of brass in this application. These include high cost, shortages of the copper required for the brass, weight — a serious objection in logistics of combat and other quantity use situations, deleterious effects of high humidity environment and consequent need for costly and troublesome protective measures, and poor shelf life of ammunition unless extreme protective measures are adopted.

Plastic cartridge cases have been proposed as a replacement for brass cartridge cases. Similarly, plastic sheaths have been suggested as the casing for blank ammunition, as described in U.S. Pat. No. 3,435,765.

The arrangement of the present invention provides numerous advantages over presently existing brass case ammunition and plastic case blank ammunition. These are:

1. Substantial reduction in cost of both training and combat ammunition.
2. Substantial reduction in weight of ammunition, with consequent logistic advantages.
3. Greatly extended adverse environment "shelf life" of ammunition.
4. Ease of cleaning of ammunition.
5. Reduced friction of projectile in rifle barrel, with greatly improved muzzle velocity/propellant charge ratio.
6. Improved reliability of ammunition.
7. Reduced rifle or pistol jamming experience.
8. Safer "training" ammunition.
9. Improved military or police fire power through reduced ammunition failure rate and through reduced weight per round and increased number of pounds which combat troops or riot control forces can carry individually.

BRIEF SUMMARY OF THE INVENTION

In accordance with a first aspect of the invention, ammunition is provided for use in connection with hand guns, rifles, semi-automatic and automatic weapons, machine guns, and the like, in which the entire continuous outer shell is a single piece of injection-molded plastic having a precisely formed outer shape of controlled thickness, with reduced thickness or strength regions in various functional areas of the sheath. One end of the sheath receives a preformed solid propellant matrix with the required air-explosive ratio, with an integral primer cap. This preform may be preloaded into the injection mold before the sheath is formed, whereby the sheath is formed around the preform. The outer end of the preform may be covered by the molded sheath so that the entire round will be protected by plastic and can be readily wiped clean. If desired, the preform can be replaced by a conventional but small caliber blank with a brass case.

In the case of practice ammunition, the continuous shell is formed with a carefully configured front surface which will rupture at its center first and flower-petal open without tearing loose of fragments which can clog the gas discharge valves in semi-automatic or automatic weapons, or which can be dangerous to bystanders.

In the case of "kill" ammunition, a bullet of lead or of lead-impregnated-vinyl is stacked on the preformed charge and is loaded into an injection mold prior to forming of the overall continuous shell with a suitable break-away surface defined at the base area of the bullet.

In the case of riot control ammunition, the shell is formed with the front end being a suitably shaped hollow or foam-filled plastic bullet which breaks away from the shell casing at a designed circumferential line and is projected from the muzzle at a suitable velocity and with suitable mass and shape to be "safe" in riot control use, having limited range and painful but non-penetrating impact.

BRIEF DESCRIPTION OF THE DRAWINGS

FIG. 1 is a longitudinal cross-sectional view of a semi-automatic rifle shell with a lead or lead-impregnated-vinyl insert bullet.

FIG. 2 is a cross-sectional view of the bullet of FIG. 1 taken across section lines 2—2 in FIG. 1.

FIG. 3 is a longitudinal cross-section of a riot control semi-automatic rifle shell with a light-weight plastic break-away bullet.

FIG. 4 is a longitudinal cross-section of a blank or practice ammunition shell with controlled fracture front surface for semi-automatic rifles in which primer and charge are separately fabricated for insertion after shell has been molded.

FIG. 5 is an end view of the right-hand end of FIG. 4.

FIG. 6 is a longitudinal cross-section of a riot control bullet for semi-automatic rifles in which the primer and charge unit are separately fabricated and inserted after molding of the plastic shell.

DETAILED DESCRIPTION OF THE DRAWINGS

Referring first to FIGS. 1 and 2, there is shown a combat ammunition shell for use in a semi-automatic rifle and has the shape and dimension required by the particular weapon. The shell of FIG. 1 consists of a bullet portion 1 and a casing portion 2, where the bullet portion 1 and casing portion 2 employ a common and continuous plastic sheath 3. Bullet portion 1 contains a lead or lead-impregnated-vinyl insert 4 which is covered by the streamlined projectileshaped portion of sheath 3.

The casing portion 2 has a rim 2a and contains a conventional premolded powder charge which has a suitable primer 6 in one end thereof. The opposite end of powder charge 5 has a shaped protrusion 7 which nests into a conforming depression in the adjacent end of projectile 4 so that the projectile 4 and charge 5 may be held relative to one another during the formation of sheath 6.

The exterior of sheath 3 is then provided with a circumferential fracture or tearing line, formed by depressions 8 of controlled depth and spacing, as shown in FIG. 2.

To make the round of FIGS. 1 and 2, the preformed charge 5 and its primer 6 are stacked with projectile 4 and are held, by a suitable jig, in a conventional injectionmolding apparatus. Plastic material is then injected into the mold to form the sheath 3, and to form a thin web 9 across the primer 6 end of charge 5. Note that web 9 will be sufficiently thin to enable the rifle firing pin to fire the primer 6. The line of depressions 8, or a similar weakened line, is then formed in sheath 3. Typical plastics which can be used for sheath 3 are: acrylonitrile, butadiene, styrene, polyamide, polycarbonate, polyethylene, polypropylene and vinyl.

In operation, the bullet of FIGS. 1 and 2 is fired when the firing pin of the weapon in which it is loaded impacts primer 6 through web 9. The explosive charge 5 is then ignited and the expansion of the propellant gases generated by burning of charge 5 causes the cartridge case 2 and the projectile case 1 to part at the precisely determined weakest section defined by depressions 8, and the plastic sheathed bullet is propelled down the barrel of the rifle. The plastic sheath on projectile mass 4 gives beneficial results with respect to sealing, and response to rifling grooves, and friction is low with a suitable self-lubricating plastic bullet sheath. Muzzle velocity is greater in proportion to the weight-to-charge ratio than with a conventional metal sheathed bullet. Rifle barrel heating also is reduced in rapid fire situations, and accuracy is improved.

The number of depressions 8, their diameter relative to the radius of sheath 3, their depth as well as the tensile strength of the particular material selected for sheath 3 all determine the point at which the sheath 3 will separate. This will be determined in proportion to charge 5 of FIG. 1. These various design factors will be adjusted to the functional specifications of the ammunition; weight, range, muzzle velocity, so that the desired characteristics will be obtained.

Referring next to FIG. 3, there is shown a "riot control" foam-filled plastic bullet cartridge constructed in accordance with the invention. The cartridge of FIG. 3 is essentially the same as the combat cartridge of FIGS. 1 and 2 and similar numerals are applied to similar components. As in FIG. 1, the cartridge of FIG. 3 is a single piece, totally plastic enclosed unit, in which primer 6 is impacted by the firing pin through the thin, plastic web 9, which ignites charge 5, causing expanding gases to force rupture along the break-away ring of openings 8 (or another reduced section form). Projectile 10 in FIG. 3 is formed of a light foam plastic body which is covered with the plastic sheath 3. When the rifle is fired, the projectile 10 and its covering sheath is propelled through the barrel to emerge with a predetermined muzzle velocity such that the light weight riot control projectile 10 will cause pain without being excessively damaging under proper use. Note that in appropriate situations, the foam body 10 may be eliminated and the streamlined hollow plastic section formed by sheath 3 to the right of the ring of openings 8 can serve as the projectile.

Referring next to FIGS. 4 and 5, there is shown an embodiment of the invention wherein the cartridge is to be used for blank or practice ammunition. The plastic sheath 3 in FIG. 4 is hollow and the right-hand end of the sheath has a closed end which has reduced thickness portions at intersecting lines 20 and 21 across the end thereof. The internal diameter of sheath 3 is designed to receive a preassembled charge 22 and primer 23. These may be contained within a blank brass cartridge 24 of small caliber. For example, a standard 22 caliber blank may be fitted snuggly within sheath 3 in FIG. 5 to serve as the source of the powder charge and primer for the blank cartridge formed by sheath 3.

Note that the blank can be a fully encased brass housing with a primer so that the gun powder within the blank will not deteriorate.

In operation, when the charge 22 is ignited, gases expanding in sheath 3 eventually cause the regions 20 and 21 to rupture, thereby relieving the gas and enabling operation of shell ejector devices or the like of the weapon being fired. Note that, when the sheath 3 ruptures at its end, no pieces are ejected but the end of sheath 3 simply opens petal-like.

FIG. 6 shows a cartridge similar to that of FIGS. 1 and 2 but where the powder charge and primer are components of a small caliber brass case blank. Thus, in FIG. 6, the sheath 3 is injection-molded and the projectile mass, whether metallic or a foamed plastic mass, or the like, and a preformed small caliber blank are inserted into the hollow sheath 3. The operation of this cartridge is identical to that described in connection with the cartridge of FIGS. 1 and 2.

Although there has been described a preferred embodiment of this invention, many variations and modifications will now be apparent to those skilled in the art. Therefore, this invention is to be limited, not by the specific disclosure herein, but only by the appended claims.

The embodiments of the invention in which an exclusive privilege or property is claimed are defined as follows:

1. A live ammunition cartridge comprising, in combination: a cylindrical powder charge body having a constant diameter, a primer disposed in one end of said powder charge body, an elongated cylindrical and continuous sheath of plastic material having an axial bore of said constant diameter; a first portion of said elongated plastic sheath bore closely receiving said powder charge body with said primer being juxtaposed with one end of said elongated plastic sheath; a second portion of said sheath having an elongated projectile-shaped section which is closed at its end and which extends axially away from said powder charge body; a projectile mass disposed within and completely filling said constant diameter bore in said projectile-shaped sheath section; said first plastic sheath portion having a wall thickness sufficiently strong to withstand the forces due to expanding gas created when said powder charge is ignited by said primer; said second plastic sheath portion having a substantially constant wall thickness, said second portion wall thickness being less than said first portion wall thickness; said first plastic sheath portion being ejected with said projectile mass when said powder charge body is ignited.

2. The cartridge of claim 1 which further includes a thin planar plastic layer of constant thickness extending across said one end of said plastic sheath and covering said primer, whereby the entire cartridge outer surface is plastic and is impervious to moisture and contamination; said thin layer being sufficiently thin to transmit the force of a firing pin to said primer.

3. The cartridge of claim 1, wherein said projectile mass abuts another end of said powder charge body, and further including a circumferential tear line around said sheath at the junction outwardly formed about said another end of said powder charge body by the differing wall thicknesses of said first and second sheath portions to define a tear line at which said projectile shaped section of said sheath will separate from the remainder of said sheath when said powder charge body is ignited.

4. The cartridge of claim 3 wherein said circumferential tear line is defined by a line of spaced depressions in said plastic sheath.

5. The cartridge of claim 1 wherein said primer and said charge body are components of a brass case blank of smaller caliber than the caliber of said cartridge.

6. The cartridge of claim 1, wherein said projectile mass is of light-weight material.

* * * * *